US006042688A

United States Patent [19]

Masumura et al.

[11] Patent Number: 6,042,688

[45] Date of Patent: Mar. 28, 2000

[54] CARRIER FOR DOUBLE-SIDE POLISHING

[75] Inventors: Hisashi Masumura; Kiyoshi Suzuki, both of Nishigou-mura, Japan

[73] Assignee: Shin-Etsu Handotai Co., Ltd., Tokyo, Japan

[21] Appl. No.: 09/104,396

[22] Filed: Jun. 25, 1998

[30] Foreign Application Priority Data

Jun. 25, 1997 [JP] Japan ..... 9-184405

[51] Int. Cl.[7] ..... B24B 49/18

[52] U.S. Cl. ..... 156/345; 451/56; 451/287

[58] Field of Search ..... 156/345; 451/41, 451/285–288, 56

[56] References Cited

U.S. PATENT DOCUMENTS 5,364,655 11/1994 Nakamura et al. ..... 427/129
5,707,492 1/1998 Stager et al. ..... 156/645.1

FOREIGN PATENT DOCUMENTS 58-143954 8/1983 Japan .
8908909 8/1990 South Africa .

*Primary Examiner*—Bruce Breneman
*Assistant Examiner*—Alva C Powell
*Attorney, Agent, or Firm*—Evenson, McKeown, Edwards & Lenahan, P.L.L.C.

[57] ABSTRACT

A carrier for double-side polishing, which has a polishing pad dressing function as well as a polishing function, so that it can do removal of matter stuck to polishing pads and wear correction thereof concurrently with polishing and ensure stable work polishing accuracy. A resin-coated metal or resin ring is provided around the outer periphery of a carrier portion having work retainer holes and abrasive feed holes, and projections are formed on the upper and lower surfaces of the ring. The projections are cylindrical, triangular pyramidal, quadrangular pyramidal or conical, or they may be irregular projections formed by blasting.

7 Claims, 6 Drawing Sheets

CARRIER FOR DOUBLE-SIDE POLISHING

BACKGROUND OF THE INVENTION

1. Field of the Invention

This invention relates to carriers for polishing double sides of work pieces, held in work retainer holes, as it is rotated and revolved relative to two polishing pads between which it is interposed, and more particularly, to carriers for polishing double sides of semiconductor wafers.

2. Description of the Prior Art

Work pieces having been flattened through lapping process are subjected to a wet etching process to remove a residual damaged layer resulting from the lapping process, and then subjected to a polishing process, which permits highly accurate flatness in addition to mirror finish. The polishing process is carried out by a mechano-chemical polishing method comprising a plurality of stages.

The mechanical polishing provides a "scraping-off effect" and a "surface atom arrangement disturbance effect". The chemical polishing, on the other hand, provides a "solving effect" and a "film formation effect" to the surface of work pieces. These effects constitute a composite effect of permitting highly accurate mirror finish. At any rate, these effects are influenced by what extent is put emphasis on whether a mechanical factor or chemical factor during polishing.

In the meantime, polishing process includes the step to polish coarse surface to mirrored surface and the succeeding step to continue polishing the said mirrored surface in order to approach the necessary flatness. Particularly, semiconductor materials such as high performance products require minimized damaged layer as well as the mirror-finished surface. In other words, it is required to obtain a predetermined accurate surface flatness. The processed surface and the layer directly under the processed surface require the exactly same state as the inner part of the wafer.

For such process, double-side polishing machines for polishing double sides of disc-like work pieces are used to improve efficiency in the process.

FIGS. 9(A) and 9(B) show a conventional double-side polishing machine. As shown in FIG. 9(A), the polishing machine comprises a disc-like carrier 10, which has work retainer holes 11 formed in it and a peripheral gear 10*a* formed around its outer periphery. As shown in FIG. 9(*b*), the peripheral gear 10*a* is meshed with a sun gear 53, which is formed on the center of a lower polishing turn table 51 rotated in the direction of arrow A, and also with an internal gear 54 provided on the outer side of the lower polishing turn table 51.

The carrier used in the above conventional double-side polishing machine is the same in outward shape, number of work retainer holes as the carrier according to the present invention. For this reason, the same reference numerals and symbols are used as for the carrier 10, work retainer hole 11 and peripheral gear 10*a* in the above description, are used in the description of the present invention.

The carrier 10 actually has three work retainer holes 11. Wafers 25 as work pieces are inserted and held in the work retainer holes 11. In this state, the wafers 25 are held clamped under a proper pressure between polishing pads 51*a* and 52*a*, which serve as polisher and are applied to lower and upper polishing turn tables 51 and 52 rotated in opposite directions, so as to polish double sides of the wafers at a time by dropping predetermined abrasive slurry through an abrasive slurry feed hole 56 formed in the upper polishing turn table 52.

The carrier may be a metal body. As an example, Japanese Laid-Open Utility Model Registration No. 58-4349 proposes a resin-coated metal carrier. Carriers of other materials also have been proposed. For example, Japanese Laid-Open Patent Publication No. 58-143954 proposes a carrier which is a resin-impregnated carbon fiber laminate.

In the meantime, the high quality mirror finish mentioned above requires the use of very fine abrasive grains and a soft polisher (i.e., polishing pads). Another important factor to obtain good finish is the wear of the polishing pads. It was observed that polishing pads are worn out harshly at an initial stage of polishing, during which the wafers have considerably rough surfaces, but the wear of the polishing pads is suppressed with the progress of flattening the wafers. It is possible to take the view that in the removal of material by polishing not only the behavior of abrasive grains is concerned, but also a mechanical effect of "scraping-off" provided by the polishing pads is inevitable.

Furthermore, it is considered that a polishing mechanism is provided that a soft film (or hydrated film) formed by a chemical action, is scraped off and removed by abrasive grain and/or polishing pads as polisher. The above polishing mechanism is provided when mechanically polishing silicon wafers with colloidal silica. In this case, a combined effect of fine abrasive grains and soft polisher is provided, so that the silicon surface is not directly rubbed off, but the processing proceeds with the removal of the soft film (or hydrated film). It is thus possible to obtain non-disturbed mirror finish free from processing defects.

At any rate, wear of the polishing pads as polisher is inevitable. When a worn-out polisher is used, it is elastically deformed by the work pushed against it, thus resulting in a polished surface having a convex shape.

The amount of polishing is increased with the lapse of polishing time, and the flatness is deteriorated with increasing polishing amount. Therefore, it is necessary to correct the flatness of the polishing pads as polisher.

The abrasive grains used are very fine, i.e. 1 $\mu$m or below, while the polisher is formed by using soft materials, such as synthetic resins or fibers. During polishing, polishing reaction products, removed by polishing from the work surface by abrasive grains, are dispersed in the polishing slurry and partly stick to the surface of the polishing pads, thus deteriorating the polishing performance. To remove the stuck matter, the polishing pads should be dressed.

The polishing pads are dressed by, for instance, brushing of them with brush, which is done at an adequate frequency, or their dressing done by inserting dressing grindstones.

However, the frequency of dressing the polishing pads, even set adequately, is greatly varied according to the extent of sticking of reaction products to the polishing pad surface, which is in turn dependent on characteristics fluctuations of the polishing pads caused by in the manufacturing process thereof.

Therefore, it is necessary to determine the frequency of carrying out the dressing of the polishing pads by confirming the polishing accuracy of the polished work, and this gives rise to problems in view of the production efficiency.

Furthermore, depending on the kind of the polishing pads it is necessary to make dressing whenever the polishing is ended. The operation of dressing the polishing pads is made by removing the carrier carrying the work and inserting a carrier holding grindstone between the polishing pads, therefore it greatly reduces the production efficiency.

SUMMARY OF THE INVENTION

The present invention was made in view of the above problems, and it has an object of providing a carrier for polishing double sides of work pieces held in itself as it is rotated and revolved between an upper and a lower polishing pads, the said carrier has a function to dress polishing pads during the polishing process, thus permits removing stuck solid matter, permits grinding function and polishing function to be maintained, permits the polishing pads to be made up for wear thereof, permits stable polishing accuracy to be ensured, dispenses with conventional considerations of dressing frequency fluctuations due to quality fluctuations in the manufacturing polishing pads and permits quality fluctuations in the polishing process to be minimized.

The carrier for double-side polishing according to the present invention has the following construction.

An aspect of the present invention features a carrier for polishing double sides of work pieces, held in work retainer holes of its disc-like metal or resin-coated metal or resin body, as it is rotated and revolved between an upper and a lower polishing pad, wherein the carrier has a function of dressing the polishing pads.

The dressing function is provided by a first arrangement of dressing structure comprising a resin-coated metal or resin ring formed around the outer periphery of a carrier body portion having the work retainer holes, and projections formed on the ring.

The dressing function is also provided by a second arrangement of dressing structure comprising projections formed on the upper and lower surfaces of the carrier.

The dressing function is further provided by a third arrangement of dressing structure comprising grindstones glued in pierced holes bored in a resin-coated metal or resin carrier body.

The dressing function may still further be provided by a fourth arrangement of dressing structure comprising tapered projections provided on a peripheral gear portion of the carrier.

The dressing function is yet further be provided by a fifth arrangement of dressing structure comprising abrasive grains deposited by thermal spraying on the upper and lower uneven surfaces of the carrier.

As for another variation, the uneven surfaces is covered by diamond or diamond-like carbon.

According to the present invention, the upper and lower polishing pads can be dressed uniformly over their entire area with the rotation and revolution of the carrier in the polishing process. Thus, it is possible to eliminate loading of the upper and lower polishing pads clamping the carrier therebetween by reaction products and always make the polishing capacity of polishing pads afresh. In addition, it is possible to ensure stable high polishing accuracy. Furthermore, it is possible to dispense with dressing between polishing process cycles.

The first arrangement of dressing structure which provides the carrier with the dressing function, comprises the resin-coated metal or resin ring formed around the outer periphery of the carrier body portion having the work retainer holes and the projections formed on the ring. With the resin-coated metal or resin ring formed around the periphery part of the carrier which is out side area of the work retainer holes, it is structurally possible to ensure sufficient mechanical rigidity of the carrier. With the projections formed on the ring, a dressing function and a flatness correcting function for the upper and lower polishing pads can be obtained. That is, it is possible continuously to provide polishing pads with polishing or grinding function, to eliminate continuous wear of the polishing pads and always correct and maintain the flatness accuracy, to dress the polishing pads by removing reaction products, and always to make afresh and maintain the function of polishing the polishing pads.

The second arrangement of dressing structure which provides the carrier with the dressing function, comprises projections formed on the upper and lower surfaces of the carrier. With the projections, a grinding function and a dressing function for the polishing pads can be obtained, and loading prevention effect and effect for recovering partial wear of the polishing pads can be continuously provided. Thus, it is possible continuously to make the polishing function afresh and continuously to adjust so as to obtain good flatness.

The third arrangement of dressing structure which provides the carrier with the dressing function, comprises grindstone glued in pierced holes provided in a resin-coated metal or resin carrier body. With the grindstones, grinding and loading prevention of the polishing pads can be obtained, so that it is possible to continuously make polishing function afresh and continuously correct the flatness.

The fourth arrangement of dressing structure which provides the carrier with the dressing function, comprises tapered projections provided on the peripheral gear portion of the carrier. The tapered projections permit grinding and dressing of the polishing pads, so that it is possible to continuously make the polishing function afresh and continuously correct the flatness.

The fifth arrangement of dressing structure which provides the carrier with the dressing function, comprises ceramic abrasive grains deposited by thermal spray on the upper and lower uneven surfaces of the carrier. The ceramic abrasive grains permit grinding and dressing of the polishing pads, so that it is possible to continuously make the polishing function afresh and continuously correct the flatness.

The other aspect of the present invention is that the surfaces of the carrier are covered by resin or diamond or diamond-like carbon in order to prevent exposure of the metal part of the carrier as well as to suppress detachment of the ceramic abrasive grains and resultant wear of the carrier.

Figure 1:
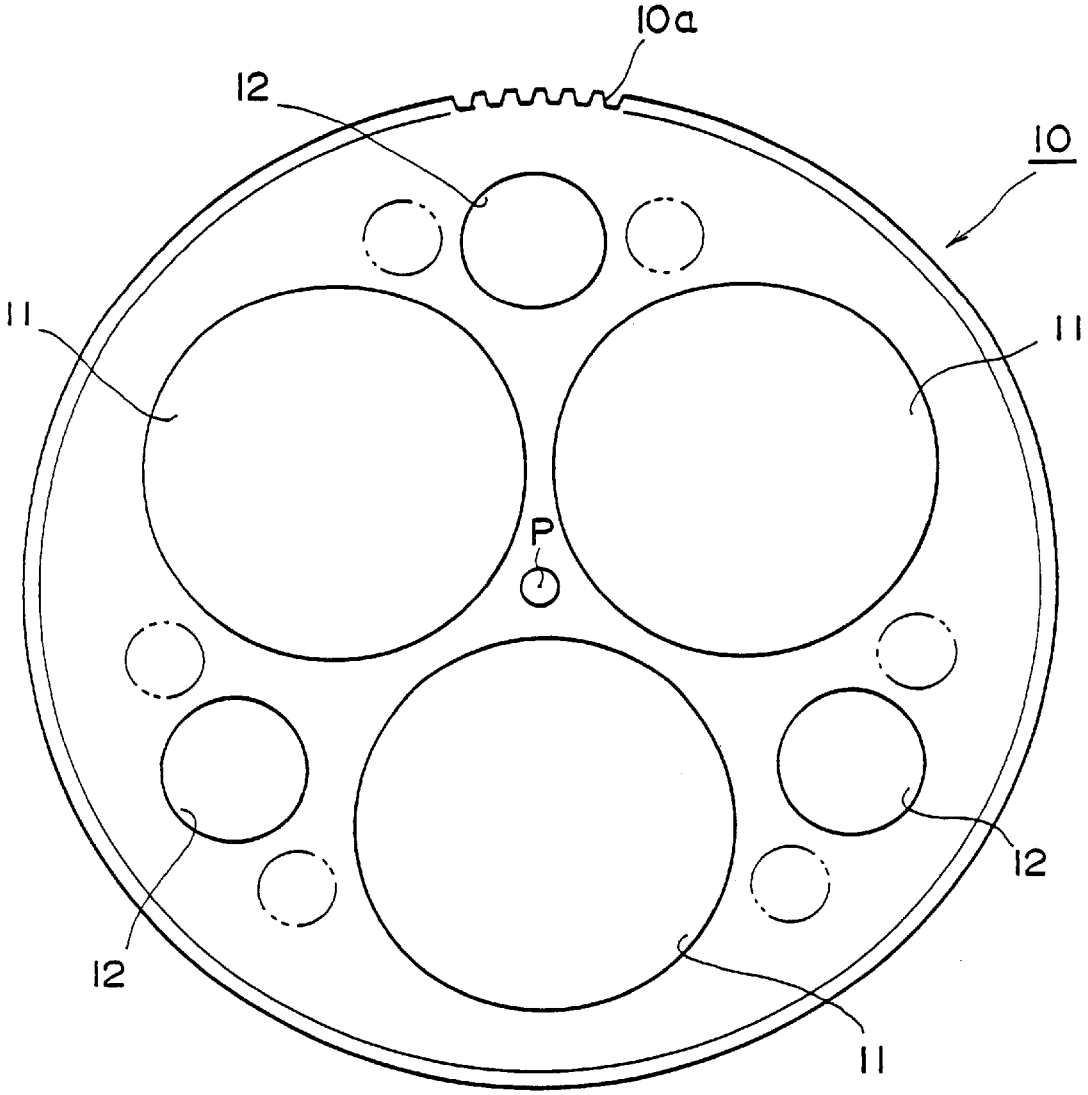
FIG. 1 is a schematic plan view showing a carrier according to the present invention.

In the Figures, reference numeral 10 designates a carrier, 10*a* a peripheral gear, 11 a work retainer hole, 12 an abrasive slurry feed hole, 13 a resin-coated metal or resin ring, 14 a surface, 15 a dressing grindstone, 16 a tapered projections, 18 ceramic abrasive grains, and 25 a work piece.

DETAILED DESCRIPTION OF THE PREFERRED EMBODIMENTS

The invention will now be described in detail in conjunction with embodiments thereof illustrated in the drawings. The sizes, materials, shapes, relative dispositions, etc. of parts described in the description of the embodiments are by no means limitative unless particularly specified, but are merely exemplary.

Figure 2:
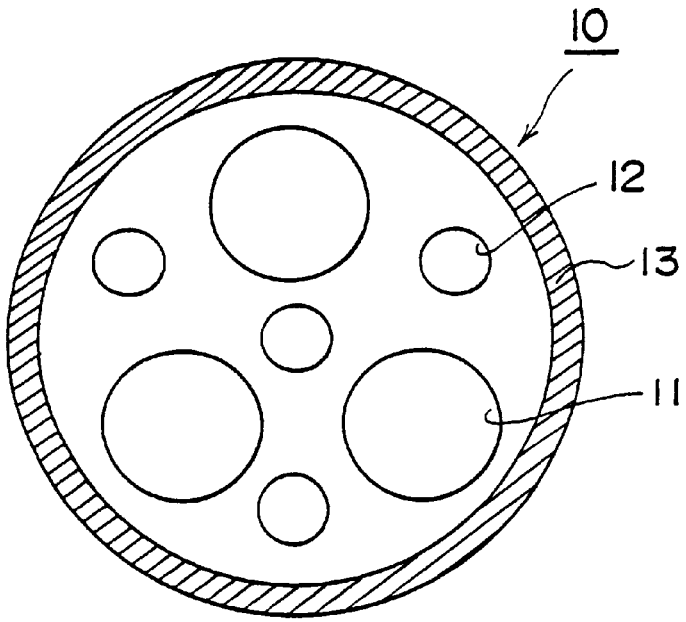
FIG. 2 is a schematic view showing a first arrangement of dressing structure provided to the carrier shown in FIG.
Figure 3:
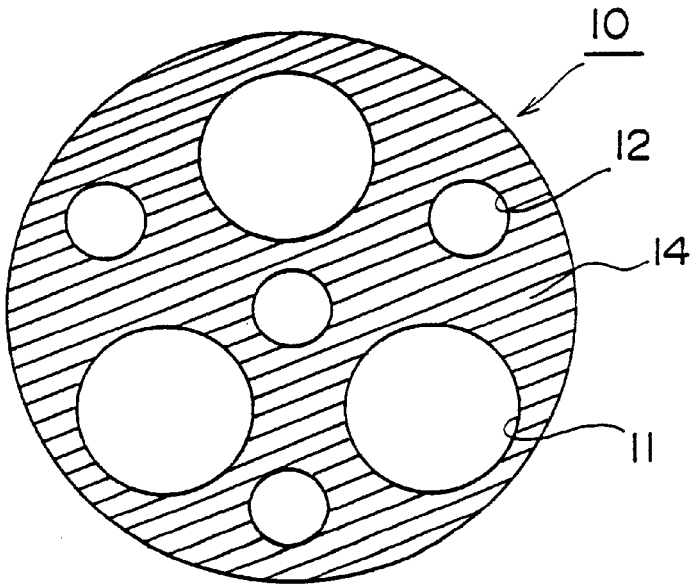
FIG. 3 is a schematic view showing a second arrangement of dressing structure provided to the carrier shown in FIG. 1.
Figure 4:
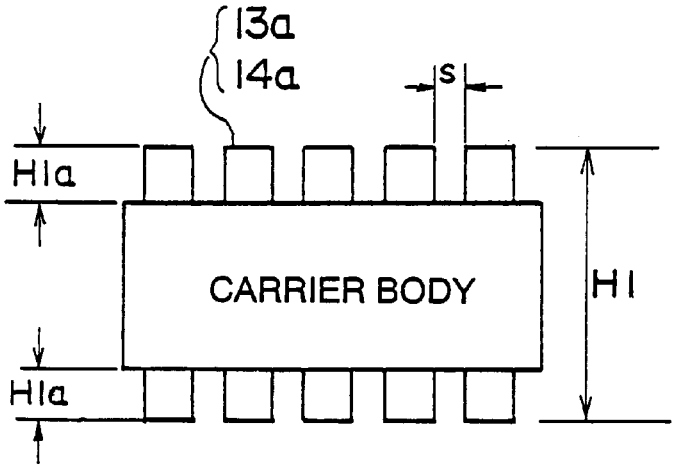
FIG. 4 is an enlarged-scale schematic view showing projections shown in FIG. 2 and 3.
Figure 5:
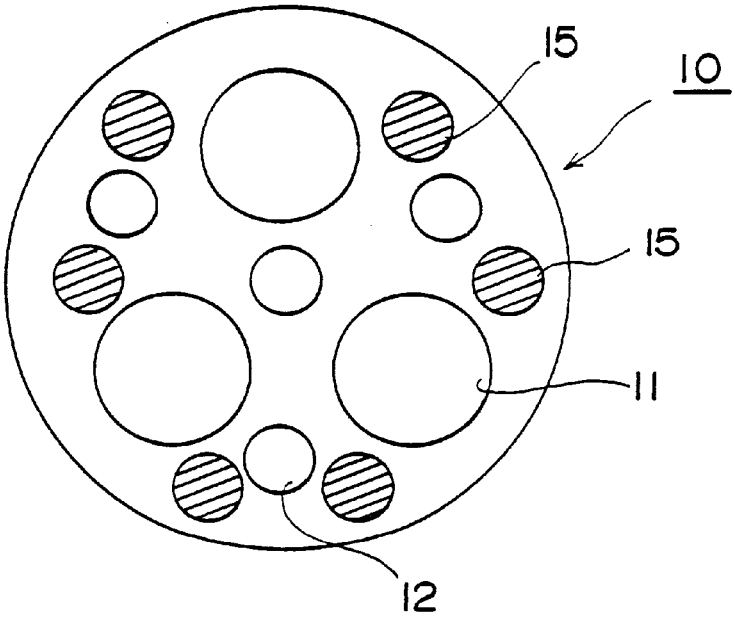
FIG. 5 is a schematic view showing a third arrangement of dressing structure provided to the carrier shown in FIG. 1.
Figure 6A:
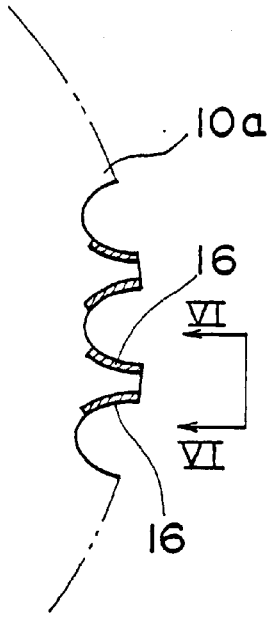
FIGS. 6(A) and 6(B) are schematic views showing a fourth arrangement of dressing structure provided to the carrier shown in FIG. 1, FIG. 6(A) being an enlarged-scale fragmentary plan view, FIG. 6(B) being a sectional view taken along line VI—VI in FIG. 6(A)
Figure 6B:
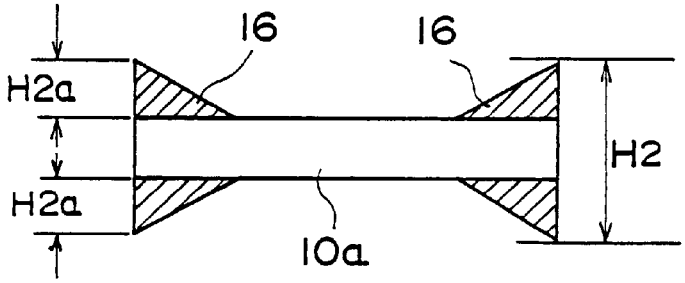
Figure 7A:
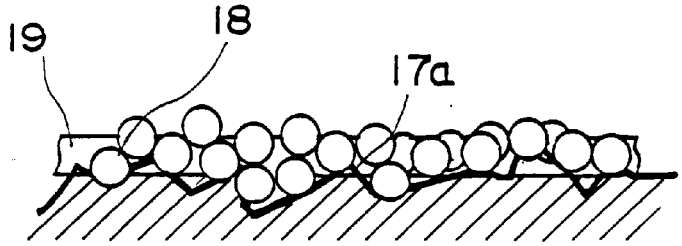
FIGS. 7(A) and 7(B) are schematic views showing a fifth arrangement of dressing structure provided to the carrier shown in FIG. 1, FIG. 7(A) being a sectional view showing an embodiment, FIG. 7(B) being a sectional view showing another embodiment.
Figure 7B:
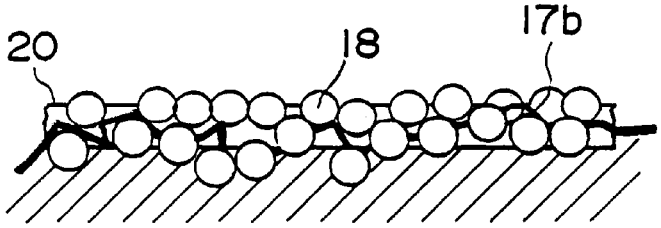

FIG. 1 is a schematic plan view showing a carrier according to the present invention. FIG. 2 is a schematic view showing a first arrangement of dressing structure provided to the carrier shown in FIG. 1. FIG. 3 is a schematic view showing a second arrangement of dressing structure provided to the carrier shown in FIG. 1. FIG. 4 is an enlarged-scale schematic view showing projections shown in FIGS. 2 and 3. FIG. 5 is a schematic view showing as third arrangement of dressing structure provided to the carrier shown in FIG. 1. FIGS. 6(A) and 6(B) are schematic views showing a fourth arrangement of dressing structure provided to the carrier shown in FIG. 1, FIG. 6(A) being an enlarged-scale fragmentary plan view, FIG. 6(B) being a sectional view taken along line VI—VI in FIG. 6(A). FIGS. 7(A) and 7(B) are schematic views showing a fifth arrangement of dressing structure provided to the carrier shown in FIG. 1, FIG. 7(A) being a schematic view showing an embodiment, FIG. 7(B) being a sectional view showing another embodiment.

As shown in FIG. 1, the carrier 10 according to the present invention is a disc-like metal or resin-coated metal or resin body, which has three work retainer holes 11 and also three abrasive slurry feed holes 12, in symmetrical arrangement. The carrier 10 further has a peripheral gear 10*a* formed in the outer periphery.

Figure 9A:
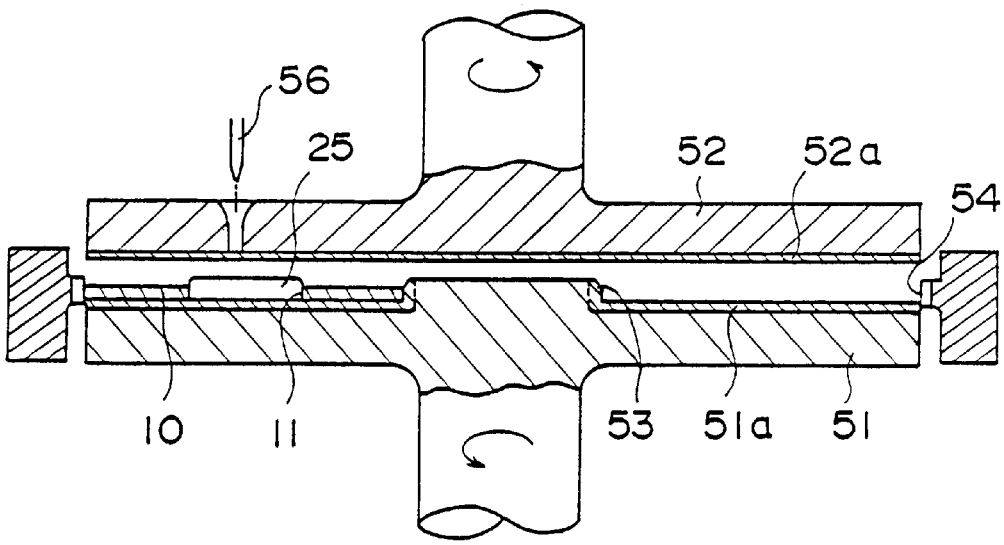
Fig. 9(A) PRIOR ART
FIGS. 9(A) and 9(B) are schematic views showing a double-side polishing machine, FIG. 9(A) being a side sectional view, FIG. 9(B) being a fragmentary plan view illustrating the status of rotation and revolution of a carrier.
Figure 9B:
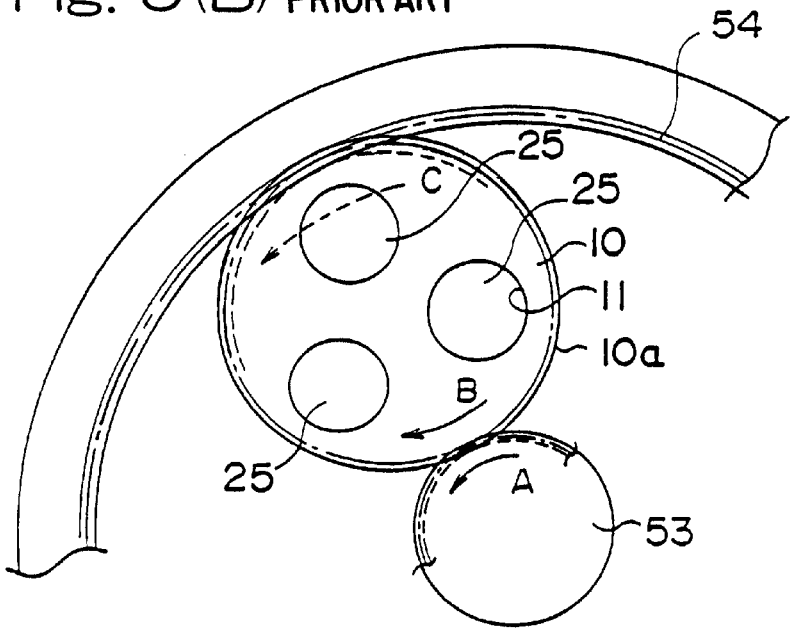
Fig. 9(B) PRIOR ART

The carrier 10 is set in the double-side polishing machine as shown in FIGS. 9(A) and 9(B) such that the peripheral gear 10*a* is in mesh with a sun gear 53 and an internal gear 54 of the double-side polishing machine for its rotation and revolution. Work pieces are inserted and held in the work retainer holes 11, so that their predetermined polishing is made as they are moved relative to polishing pads 51*a* and 52*a*, which are applied to upper and lower polisher supports 51 and 52 rotated in opposite directions.

FIG. 2 shows a first arrangement of dressing structure providing the carrier 10 with a dressing function. As shown, the dressing structure comprises a resin-coated metal or resin ring 13 formed around the outer periphery of a carrier body portion having the work retainer holes 11 and the abrasive slurry feed holes 12, and projections 13*a* formed on the upper and lower surfaces of the ring, as shown hatched in FIG. 2, to a height H1*a* and at an interval s as shown in FIG. 4. The projections 13*a* may be cylindrical, triangular pyramidal, quadrangular pyramidal or conical in shape, or they may be irregular projections formed by blasting. As an alternative, deposition of ceramic materials by thermal spraying or coating of a plastic material on the carrier surfaces may be made after masking the carrier surfaces. As a further alternative, a plastic plate (for instance glass epoxy laminate)embossed with the meshes of a net may be applied to the carrier surface. The thickness H1 of the resin-coated metal or resin ring, inclusive of the projections provided on the both sides, is desirably close to the finish thickness of the polished work, and should be set by taking the finish thickness, mechanical strength, dressing effect, etc. into considerations.

For example, where the finish thickness of the polished work is 725 μm, the thickness of the carrier exclusive of the projections should be 600 μm from the standpoint of the mechanical strength. The difference between the finish thickness and the thickness H1 of the carrier inclusive of the projections (i.e., finish thickness minus carrier thickness) should be 0 to 50 μm. When the difference is below this range (i.e., negative), the necessary flatness of work cannot be obtained. When the difference is above the range, on the other hand, the effect of dressing the polishing pads cannot be obtained.

The height H1*a* of the projections for the dressing may be 5.0 μm or above, and with a smaller height the obtainable effect is reduced. The interval s of the projections ranges from 10 μm to 10 mm, and preferably smaller for obtaining greater effect. It is suitable to form the carrier such as to meet the above thickness range.

With the resin-coated metal or resin ring formed around the outer periphery of the body portion of the carrier 10 having pluralities of work retainer holes and abrasive slurry feed holes, it is structurally possible to ensure sufficient mechanical rigidity of the carrier. In addition, the projections formed on the upper and lower surfaces of the ring, provide a function of correcting the flatness of the polishing pads.

That is, it is possible to provide polishing pads with a continuous polishing or grinding function, to eliminate continuous wear of the polishing pads so as always to maintain corrected flatness accuracy, and dress the polishing pads by removal of reaction products.

FIG. 3 shows a second arrangement of dressing structure providing the carrier 120 with a dressing function. As shown, the dressing structure comprises projections 14*a* formed on the upper and lower surfaces, as shown hatched in FIG. 3, to a height H1*a* and at an interval s as shown in FIG. 4. The projections 14*a* may be cylindrical, triangular pyramidal, quadrangular pyramidal or conical in shape, or they may be irregular projections formed by blasting. As an alternative, deposition of ceramic materials by thermal spraying or coating of plastic material on the carrier surfaces may be made after masking the carrier surfaces. As a further alternative, a plastic plate (for instance glass epoxy laminate)embossed with the meshes of a net may be applied to the carrier surface. The thickness H1 of the resin-coated metal or resin ring, inclusive of the projections provided on the both sides, is desirably close to the finish thickness of the polished work, and should be set by taking the finish thickness, mechanical strength, dressing effect, etc. into considerations.

With the projections formed on the carrier surfaces, a grinding function and a polishing function for the polishing pads facing each other can be obtained, and loading prevention effect and effect for recovering partial wear of the polishing pads be continuously provided. Thus, it is possible to continuously make the polishing function afresh and continuously adjust so as to obtain good flatness.

FIG. 5 shows a third arrangement of dressing structure providing the carrier 10 with a dressing function. As shown, the dressing structure comprises dressing grindstones 15, as shown hatched in FIG. 5, provided in pierced holes formed in a resin-coated metal or resin body of carrier 10. With the grindstones, a grinding function and a dressing function for the polishing pads can be provided, so that it is possible to continuously make polishing function afresh and continuously correct the flatness.

The grindstones 15 may be those used in a fifth arrangement of dressing structure to be described later or the shape of the projections described above.

FIGS. 6(A) and 6(B) show a fourth arrangement of dressing structure providing the carrier 10 with a dressing function. As shown, the dressing structure comprises tapered projections 16, as shown hatched, provided in the both sides of the tooth tip of the peripheral gear 19*a* of the carrier 10 to a height H2. The tapered projections have a shape as shown in FIG. 6(B) which is a section taken along line VI—VI in FIG. 6(A). The thickness H2 of the carrier inclusive of the opposite side tapered projections 16, is desirably close to the finish thickness of the polished work, and should be set by taking the finish thickness, mechanical strength, dressing effect, etc. into considerations.

The tapered projections may be formed in any way. For example, the carrier body, particularly the peripheral gear portion thereof, is formed from a metal and the tooth tip portion is pressed to yield the necessary shape. The surfaces of these portions are then coated with a plastic or ceramic material. Alternatively, tapered plastic members (for instance glass epoxy members) may be applied to the gear portion.

As an example, where the finish thickness of the polished work is 725 $\mu$m, the thickness of the carrier exclusive of the projections should be 600 $\mu$m from the standpoint of the mechanical strength. In addition, the difference between the finish thickness and the thickness H2 of the carrier inclusive of the projections (i.e., finish thickness minus carrier thickness) should be 0 to 50 $\mu$m. When the difference is below this range (i.e., negative), sufficient flatness of the work cannot be obtained. When the difference is above the range, on the other hand, the effect of dressing the polishing pads can not be obtained.

The height H2*a* of the projections for the dressing may be 5.0 $\mu$m or above. By reducing the height the obtainable effect is reduced.

The tapered projections 16 permit grinding and dressing of the polished pads, so that it is possible to continuously make the polishing function afresh and continuously correct the thickness.

FIG. 7(A) shows a fifth arrangement of dressing structure providing the carrier 10 with a dressing function. As shown, the dressing structure comprises ceramic abrasive grains 18 (with a grain size of #50 to #400), which are deposited by thermal spraying on machined or blasted upper and lower uneven surfaces of the carrier 10, the surfaces being then covered with epoxy resin 19, thus enhancing the dressing function.

Alternatively, as shown in FIG. 7(B), after depositing ceramic abrasive grains 18 (with a grain size of #50 to #400) by thermal spraying on machined or blasted upper and lower uneven surfaces of the carrier 10, a resin or diamond or diamond-like carbon coating 20 is provided. This arrangement seeks prevention of the exposure of metal on the carrier surface, prevention of the detachment of ceramic and prevention of wear due to the detachment.

The surface roughness of the uneven surfaces 17*a* and 17*b* may be 0.5 $\mu$m or above as mean surface roughness Ra. There is no upper limit of surface roughness, but the actual surface roughness is suitably about 10 $\mu$m.

The ceramic abrasive grains 18 permit continuous polishing and dressing of the polishing pads, so that it is possible to continuously make polishing function afresh and continuously correct the flatness.

As an example, a carrier was produced by adopting the second arrangement of dressing structure according to the present invention.

To obtain a finish thickness of 725 $\mu$m of the polished work, the thickness of the carrier exclusive of the height HI of the projections was set to about 690 $\mu$m, and projections were formed on the surfaces to a height H1*a* of 15 $\mu$m on one side and at an interval s of 100 $\mu$m. The carrier thus formed had a thickness of 720 $\mu$m.

Another carrier was produced adopting the third arrangement of dressing structure.

Pieces of grindstone base material were deposited on the surface with alumina abrasive grains by plasma spraying. Then the said pieces were coated with epoxy resin. Thus produced grindstones were glued in the six holes with diameter of 20 mm formed in an outer peripheral portion of the carrier.

The following tests were conducted using the carriers adopting the fourth and fifth arrangements of dressing structure according to the present invention and also compared with the carrier without any dressing structure.

Sample wafer: Etched wafer of CZ single crystal, p-type, with crystal orientation of <100>, a diameter of 200 mm and a thickness of 745 $\mu$m.

Tested carriers:

Example No. 1: Epoxy-resin-coated carbon steel carrier 700 $\mu$m thick, obtained by providing an peripheral gear portion of said carrier with tapered projections with a height H2*a* of 12.65 $\mu$m on one side, the tapered projections of which are also coated with epoxy resin (formed using the fourth arrangement of dressing structure).

Example No. 2: A carrier approximately 725 $\mu$m thick, obtained by depositing alumina abrasive grains (with a grain size of #200) through plasma spraying on an carbon steel carrier (about 600 $\mu$m thick) with a blasted surface roughness Ra of 5.0 $\mu$m, and then providing an epoxy resin coating layer about 7.5 $\mu$m thick (formed using the fifth arrangement of dressing structure)

Control: Epoxy-resin coated carbon steel carrier 700 Pm thick.

Abrasive pad: Non-woven cloth with a hardness (Asker C hardness: JIS K6301) of 80

Abrasive: Colloidal silica abrasive (with a pH of 10.5)

Polishing Load: 150 g/cm$^2$

Polishing stock removal: 20

Figure 8:
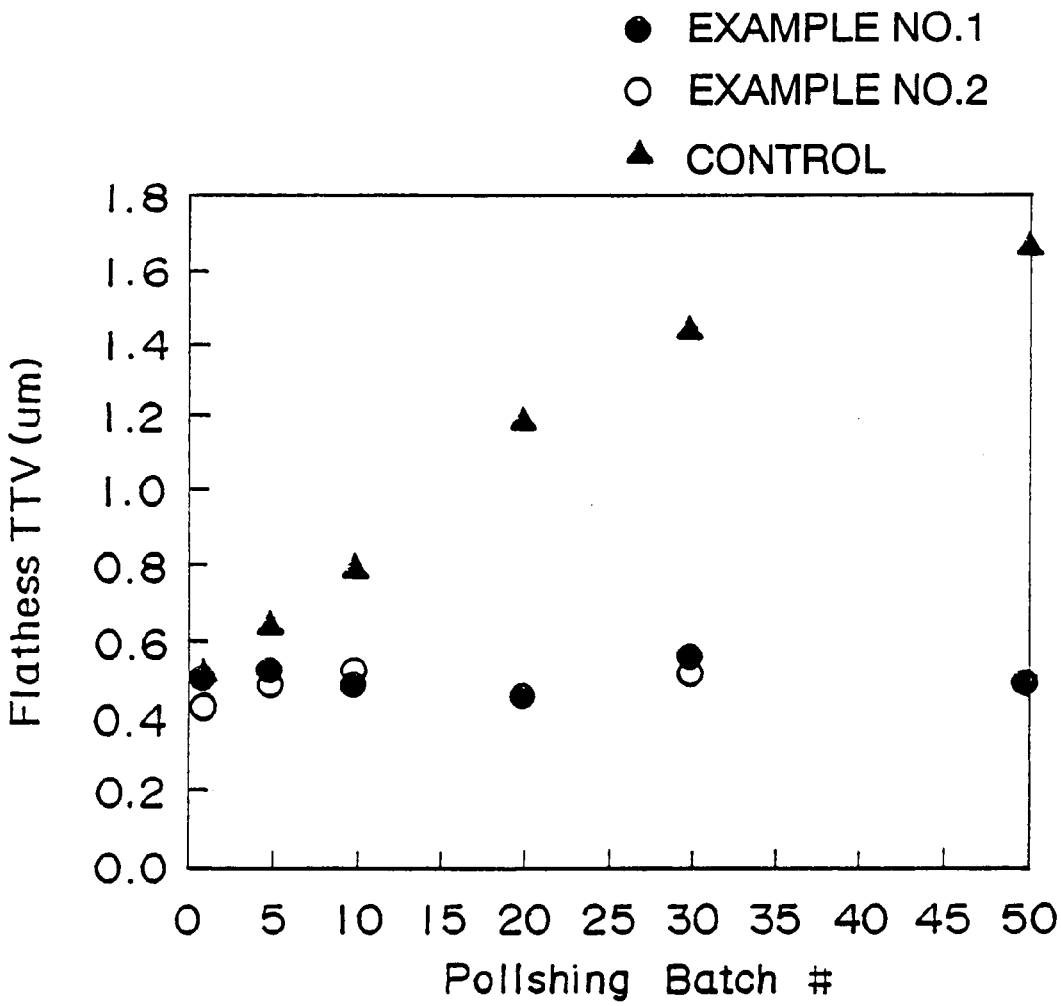
FIG. 8 is a graph showing comparison test results.

FIG. 8 shows results of the tests. As shown, with Control the flatness TTV (total thickness variation) of the work was deteriorated progressively with increasing polishing batches, whereas with Examples No. 1 and 2 stable flatness could be obtained.

In addition, with Control stuck matter on the polishing pad surfaces was observed in about several batches, whereas in the examples no stuck matter could be visually observed on the polishing pad surface within the test range.

As has been described in the foregoing, with the constitution according to the present invention it is possible to obtain dressing and flatness correction of polishing pad, thus permitting stable work polishing accuracy to be obtained.

In addition, it is possible to reduce conventional dressing and flatness correcting operations, which were carried out by stopping the machine during polishing and removing the carriers, and thus improve the operation efficiency.

We claim:

1. A carrier for polishing double sides of work pieces, comprising:

a disc-like metal or resin coated metal or resin body including work retainer holes by which the work pieces are held as the body is rotated and revolved, and upper and a lower polishing pads relative to which the body is rotated and revolved and between which the body is interposed, wherein the carrier dresses the polishing pads while polishing the double sides of work pieces so that the double sides of the work pieces can be polished without interruption.

2. The carrier for polishing double sides of work pieces according to claim 1, wherein dressing is provided by dressing structure comprising a resin-coated metal or resin ring formed around the outer periphery of a carrier body portion having the work retainer holes, and projections formed on the ring.

3. The carrier for polishing double sides of work pieces according to claim 1, wherein dressing is provided by dressing structure comprising projections formed on the upper and lower surfaces of the carrier.

4. The carrier for polishing double sides of work pieces according to claim 1, wherein dressing is provided by dressing structure comprising grindstones glued in pierced holes provided in a resin-coated metal or resin carrier body.

5. The carrier for polishing double sides of work pieces according to claim 1, wherein dressing is provided by dressing structure comprising tapered projections provided on a peripheral gear portion of the carrier.

6. The carrier for polishing double sides of work pieces according to claim 1, wherein dressing is provided by dressing structure comprising ceramic abrasive grains deposited by thermal spraying on the upper and lower uneven surfaces of the carrier.

7. The carrier for polishing double sides of work pieces according to claim 6, wherein the uneven surfaces are covered by diamond or diamond-like carbon.

* * * * *